United States Patent [19]

August

[11] 3,977,374

[45] Aug. 31, 1976

[54] ARRANGEMENT FOR THE PREPARATION OF THE FUEL-AIR MIXTURE FOR AN INTERNAL COMBUSTION ENGINE

[76] Inventor: Paul August, Capellades 1, Barcelona 6, Spain

[22] Filed: May 2, 1972

[21] Appl. No.: 249,632

[52] U.S. Cl. ..... 123/119 R; 123/139 AW; 123/141

[51] Int. Cl.[2] ..... F02N 7/00; F02N 13/00; F02N 39/00

[58] Field of Search ..... 123/139 AW, 141, 119 R, 123/188 M; 261/62, 78

[56] References Cited

UNITED STATES PATENTS

| | | | |
|---|---|---|---|
| 1,526,963 | 2/1925 | Chandler | 123/141 |
| 1,632,196 | 6/1927 | Rhoads | 123/141 |
| 1,790,854 | 2/1931 | DeFrance et al. | 123/141 |
| 2,860,616 | 11/1958 | Dermond | 123/139 AW |
| 2,893,365 | 7/1959 | Haefner | 123/139 AW |
| 3,282,572 | 11/1966 | Karlovitz | 261/78 R |
| 3,395,899 | 8/1968 | Kopa | 123/141 X |
| 3,498,274 | 3/1970 | Chapman | 123/139 AW |
| 3,608,531 | 6/1971 | Baxendale et al. | 123/139 AW |
| 3,707,278 | 12/1972 | Landrum et al. | 261/62 |

FOREIGN PATENTS OR APPLICATIONS

| | | | |
|---|---|---|---|
| 950,776 | 2/1964 | United Kingdom | 123/139 AW |
| 1,015,555 | 1/1966 | United Kingdom | 123/188 IM |

*Primary Examiner*—Wendell E. Burns
*Attorney, Agent, or Firm*—Andrus, Sceales, Starke & Sawall

[57] ABSTRACT

An arrangement for the preparation of the fuel-intake air mixture for an internal combustion engine includes an idle fuel nozzle located in the engine induction manifold. Additional fuel nozzles, located in the intake air passage, are operable to supply fuel during other portions of the operating range. The fuel air mixtures formed by the arrangement are passed at speeds approaching sonic velocity to obtain a highly desirable mixing thereof.

17 Claims, 1 Drawing Figure

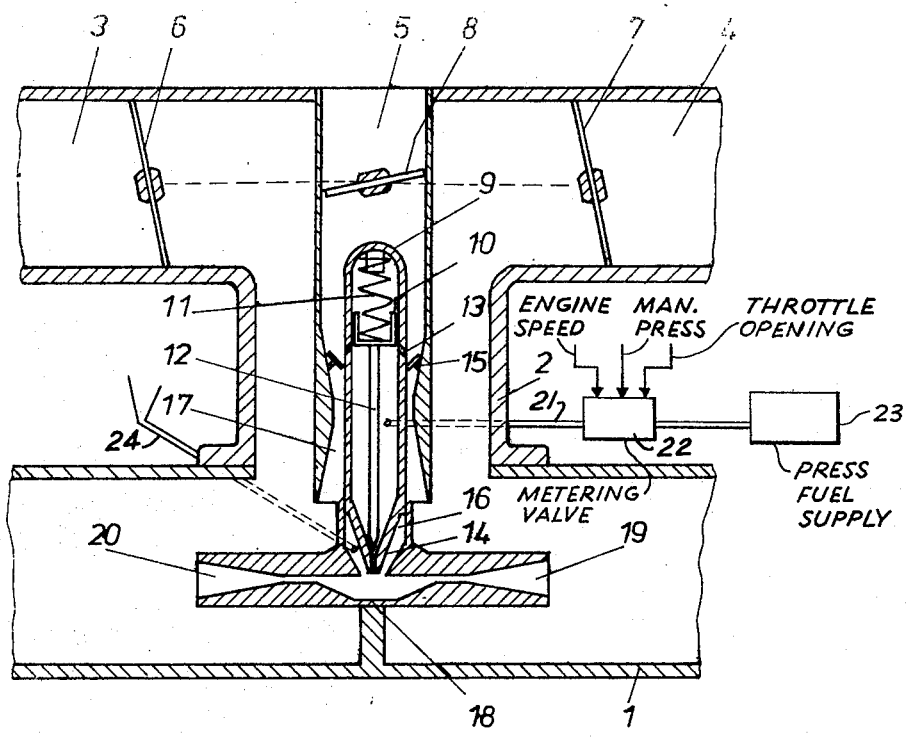
3
6
5
8
7
4
9
10
11
13
ENGINE SPEED
MAN. PRESS
THROTTLE OPENING
12
15
2
21
17
23
24
22
PRESS FUEL SUPPLY
16
METERING VALVE
20
14
19
18
1

ARRANGEMENT FOR THE PREPARATION OF THE FUEL-AIR MIXTURE FOR AN INTERNAL COMBUSTION ENGINE

BACKGROUND AND SUMMARY OF THE INVENTION

The present invention relates to an arrangement for the preparation of the fuel-air mixture for an internal combustion engine operating under variable conditions and more specifically to an arrangement having a controlling jet for the fuel in the induction manifold.

In the preparation of the fuel-air mixture it is important that the fuel entering the induction manifold be so finely divided that, for example, only particles of a size under 10 microns be present.

To this end, there are known devices containing means for effecting good atomization of the fuel. However, the disadvantage of these devices was that while single small particles under 10 microns in size were attained, over all an insufficiently fine mist was created to provide complete combustion. Complete combustion must be attained if condensate formation in the induction manifold is to be avoided and proper filling of the cylinders is to be provided. Further, heretofore known devices were constructed such that only during one portion of the operating range, for example, idling conditions, or part load conditions, or full load conditions, was a good treatment of the fuel-air mixture achieved.

It is, therefore, the object of the present invention to provide an arrangement for preparing the fuel-air mixture so as to attain extremely small particle size of the fuel over the entire operating range of the engine, resulting in complete or nearly complete combustion.

To this end, the fuel openings of a known device, for example, a venturi-pipe, Laval-nozzle, and the like, are arranged so that the fuel-air mixture being drawn in, usually by manifold vacuum, approaches sonic velocity in the region of the arrangement of the present invention. While it has heretofore been attempted to attain better preparation of the fuel-air mixture through raising its speed, the use of extremely high speeds, approaching sonic velocity, has not been attempted. Through such extremely high speeds, a tearing of the fuel particles into extremely fine particles, that is, under 10 microns in size, and an intimate mixing with the intake air will be attained. As a result, a heretofore unknown thorough and almost residue free burning of the induction fuel-air mixture and proportionate filling of the cylinders is possible.

A further feature of the present invention consists in the provision of a device for the production of sonic velocities for the mixture under idling and partly loaded conditions.

In accordance with the present invention, the operating range of the internal combustion engine is broken down into various operating regions. Conditions established in the idling condition range are utilized to overcome other conditions in the part load and full load range, that is, the device produces small quantities of intake air at sonic velocity which are utilized to achieve improved operation in the part load and full load ranges.

Accordingly, a further feature of the invention is the provision of a device for the preparation of the idle mixture directly in the induction manifold and having means for part load operation above or upstream of the idle mixture device in the flow direction of the intake air.

The opening for the preparation of the idle mixture lies in the induction manifold but minimal control of this mixture in the cylinder is sufficient to prevent the deposit of condensate particles because of the small requirements of fuel and air from the device containing the opening.

In order to reduce cost and space requirements it is desirable that the sonic velocity in the device be produced through the induction vacuum of the motor. This vacuum depends on operating condition changes so that the production of the sonic velocity in the device of the present invention is responsive thereto. It is also possible to utilize superchargers, or similar means, to produce the sonic velocity, by means of which the additionally flowing air assists in the production of the sonic velocity while if the design so permits, the pressure atomizes the fuel.

A preferred embodiment of the invention is a vacuum operated device in which the passages, channels, or other structures for the mixture formation by injection at different areas are formed so that in the flow direction, first a converging, then a parallel, and finally a diverging passages or spaces are presented. By this configuration high flow velocities and mixing is obtained and achievement of the purposes of the invention is assured.

It has been found that the use of the parallel passage portions referred to above, while desirable, are not essential and the passages, channels, or other structures may be formed so as to present, in the flow direction, first a converging and then a diverging passages or spaces. The parallel space may be dispensed with when, for example, small fuel particle size is not absolutely necessary.

In another aspect of the invention, a ring like passage is formed about a fuel nozzle for opening in the device. Through this passage, all or almost all of the air necessary for idling operating is provided. In the narrow portion of the passage the nozzle is positioned.

In yet another aspect of the present invention a flat plate is positioned opposite a fuel nozzle or opening to provide still more intimately mixing of the already small fuel particles with the intake air.

The nozzle opening may be provided with a needle valve regulating apparatus or the like. It will be appreciated that one or more nozzle bodies may be employed having one or more nozzle openings with the associated sonic velocity producing structure.

A still further aspect of the present invention contemplates the provision of a fuel injection nozzle body in an air entrance passage having a throttle valve. The throttle valve may be regulated so that sufficient intake air is provided to attain sonic velocity in the air passage. In the alternative, a carburetor may be employed in lieu of the injection nozzle body. Additionally, air entrance passages having one or more openings to the atmosphere and appropriate regulating throttle valves may be employed to provide additional intake air to the above described apparatus necessary to meet operating requirements in the above part load to the full load ranges. The control of the air passages may be coordinated by a mechanism which first operates the throttle valve associated with the device for producing sonic velocity and thereafter operates the throttle valve for the aforesaid additional air passages.

With the present invention exhaust gas in amounts of from 10% to 20% of the intake air may be supplied in the latter, thereby reducing the nitric oxide content of the engine emissions.

BRIEF DESCRIPTION OF THE DRAWING

The single FIGURE is a fragmentary cross sectional view of the device of the present invention with an associated induction manifold.

DESCRIPTION OF THE PREFERRED EMBODIMENT

The mixture and control device 2 of the present invention is shown in the FIGURE as connected to induction manifold 1. The device has three air entrances 3, 4, and 5 with associated throttle valves 6, 7, and 8. A nozzle body 9 is mounted in the middle of air entrance passage 5. Piston 10, located in body 9, is biased by spring 11. Piston 10 contains needle 12 which seals opening 14. In its movement in body 9 against the bias of spring 11, piston 10 opens first opening 14 and then ports 13 located in the sides of nozzle body 9. A conduit 21 permits fuel to be supplied to the interior of nozzle body 9 underneath piston 10 from metering valve 22 controllable in accordance with engine speed, throttle opening and manifold pressure and pressurized fuel supply 23.

Also as shown in the FIGURE, the inner wall of air passage 5 is formed so that the passage narrows under ports 13. The inner wall of air passage 5 is further formed so that, in the direction of air flow, the passage has a parallel portion and thereafter an enlarged portion 17. Small plates 15 may be spacedly mounted on the inner wall of air passage 5 under ports 13, normal to the direction of discharge from ports 13.

The lower portion of nozzle body 9 adjacent opening 14 is surrounded by space 16 which narrows at its lower end. Opposite opening 14 is located a flat plate-like area 18 in the passage in which the fuel-air mixture is drawn into the cylinders. The aforesaid passages have first converging, then parallel, and finally diverging portions 19 and 20.

The operation of the device of the present invention is as follows. With the operation of the motor and associated fuel supply system, fuel is supplied in nozzle body 9 under piston 10. In idling operation, the speed and load conditions are such that the quantity of fuel supplied biases piston 10 against spring 11 only to an extent sufficient to raise needle 12 and open opening 14. The fuel from opening 14 sprays on the flat plate-like area 18 and forms a fine mist.

The supply of air necessary for idling operating is provided to space 16 by passage 24, and exits around the nozzle of opening 14 at very high speed in the space over flat plate-like area 18. A very high air flow is thus produced through this area. The outlet cross section, and specifically the configuration of the nozzle of opening 14, and hence the extent to which space 16 narrows, determines the quantity of air for idle operation.

The fuel with the air becomes mixed in the space above plate-like area 18 and from there is drawn into the individual cylinders through outlets 19 and 20. These outlets have first converging, then parallel, and then diverging portions which control the speed of the idle fuel-air mixture. As a result, the fuel particles are reduced to a size of under 5 microns.

As additional fuel is sprayed out of opening 14, the necessary air is provided in air passage 5 by opening throttle valve 8. This additional air mixes in the induction manifold with the atomized fuel-air mixture discharged out of openings 19 and 20.

With further increases in speed and load conditions, the pressure of the fuel in nozzle body 9 against piston 10 increases, biasing the piston against spring 11 and opening ports 13. The fuel discharged from ports 13 sprays on plates 15 and is distributed as a fine mist in the passing air stream. This fuel particle laden air stream also flows through an air passage forming first converging, then parallel, and finally diverging portions 17.

For still further increases in speed and load conditions, a second, higher row of fuel ports 13 can be employed to provide more fuel with the higher and sonic air velocities in air passage 5.

From medium performance conditions to full load operation, throttle valves 6 and 7 are additionally opened so that the intake air necessary for the additional quantities of fuel in air passage 5 is provided and, in the entrance to induction manifold 1, is intimately mixed with the fuel-air mixture previously prepared in air passage 5.

Through the herein described arrangement, the fuel with a determined quantity of air is thus finely mixed over conditions extending from idle to full load. Further, by means of the very high and sonic velocity flow speeds, the misting of fine particles is found, while in the diverging portions lower speed atomization is found. The absence of a wall condensate is attributable to the fact that from medium performance conditions to full load, the air from air entrances 3 and 4 flows between the mixture formation elements and the outer wall so that the portion of the air stream near the surface of the induction manifold tends to contain pure air.

It has been shown that with a mixture formation of the above described kind, in which the fuel particles are finely misted, it becomes possible to supply a proportionately greater quantity of exhaust gas in the intake air for the purpose of reducing the nitric oxide formation with the combustion.

With the usual mixture formation techniques utilizing a carburetor or a fuel injector only approximately 6% exhaust gas from the cylinders can be fed into the intake air. With the present invention however, 15% or more exhaust gas can be supplied, resulting in a lowering of the nitric oxide formation about 80%. This exhaust gas may be provided to space 16 and results in the following advantages;

1. The exhaust gas heats the intake air, providing advantageous preparation of the fuel particles;

2. For similar conditions, the quantity of gas flowing through air passage 5 is increased approximately 15% by the gas discharge from space 16, leading to still better mixing and misting of the fuel drops in the sonic velocity range;

3. It has been shown that more exhaust gas can be fed when it is contained in the area of the somewhat richer parts of the whole mixture.

During idle operation the control element for the exhaust gas supply is closed.

Control of the intake air may also be obtained through a double gate valve and the intake air necessary for operation under middle to full performance conditions, may, if desired, be fed through one or many openings.

The supply of fuel from the fuel supply system to the holes, such as opening 14 and ports 13, may also be accomplished by means of two nozzle bodies having the desired holes. Coordinated operation of the two nozzle bodies may be effected by the speed valve or a pressure valve whereby under idle and part load operation, the fuel is fed only out of one opening 14 and from the middle of the part load range to full load operation is fed out of additional openings in the two nozzle bodies.

The arrangement according to this invention, in which the discharging fuel becomes finely dispersed with the intake air by means of sonic and subsonic velocity atomization occurring in the converging, parallel, and finally diverging portions of the air passages, is not limited to the specific nozzle opening and position configuration shown herein, but includes other arrangements and positions of the nozzles by which the desired fuel-air mixture may be obtained.

Various modes of carrying out the invention are contemplated as being within the scope of the following claims particularly pointing out and distinctly claiming the subject matter which is regarded as the invention.

I claim:

1. A device for the preparation of the fuel-air mixture for an external combustion engine from sources of fuel and air, said engine being subjected to variable operating conditions including an idling condition, and having an induction manifold with an axis along which said fuel-air mixture flows, said device comprising:

a fuel-air providing means including a fuel nozzle couplable to the source of fuel for spraying a stream of finely divided fuel particles sufficient in quantity for the idling condition of the engine, said nozzle spraying the fuel stream perpendicular to the manifold flow axis, said fuel-air providing means further having air providing means couplable to the source of air and operatively associated with said nozzle for providing an idling condition air quantity coaxially contiguous with said fuel particle stream; and discharge means connected to said fuel-air providing means and lying within said induction manifold, said discharge means having an opening for discharging the fuel-air mixture along the axis of the manifold, said discharge means including an internal cavity having a flat surface lying normal to the spray direction of the nozzle for receiving and mixing the fuel-air stream from said fuel-air providing means, said discharge means further having an elongated passage connecting said cavity with said opening and lying parallel with the manifold flow axis, said passage having at least a converging portion providing a reduced cross sectional area in said passage between said cavity and said opening for accelerating idling quantities of the fuel-air mixture to at least approach sonic velocities.

2. The device according to claim 1 including an air entrance passage means joined to the induction manifold and opening therein, said fuel-air mixture providing means being at least partially located within said air entrance passage means for forming an air passage into the induction manifold between the exterior surface of the fuel-air providing means and the interior surface of said air entrance passage means, said fuel-air providing means including additional fuel nozzles for spraying fuel into the air entrance passage.

3. The device according to claim 2 wherein at least one of the opposing surfaces of the air entrance passage means and the fuel-air providing means are formed with a converging portion in the direction of flow through the air entrance passage means, said portion reducing the cross sectional area of the air entrance passage sufficiently to accelerate the air to at least approach sonic velocity.

4. The device according to claim 2, wherein said fuel-air providing means contains means for selectively opening and closing the idle nozzle and said additional nozzles responsive to engine operating conditions.

5. The device according to claim 4 wherein said fuel-air providing means includes a hollow body for receiving fuel in a quantity responsive to engine operating conditions, said hollow body containing a nozzle control element movable responsive to the quantity of fuel in said body for initially opening said idle fuel quantity nozzle to supply fuel therefrom and thereafter opening said additional nozzle means to provide fuel therefrom as engine operating conditions and the quantity of fuel within said body increases.

6. The device according to claim 2 wherein said air passage means is further defined as containing means presenting a flat surface normal to the direction of fuel sprayed from said additional fuel nozzles for receiving the fuel.

7. The device according to claim 1 wherein said passage is further defined as subject to the induction manifold pressure of the engine for urging the flow of the fuel-air mixture through the passage.

8. The device according to claim 7 wherein the internal combustion engine includes means for creating positive induction manifold pressures and said passage means is subject to the positive manifold pressures so produced.

9. The device according to claim 1 wherein said passage further described as having first converging, and then diverging portions in the direction of flow.

10. The device according to claim 1 wherein the passage if further described as having a parallel portion interposed between said converging and diverging portions.

11. The device according to claim 3 wherein said one surface is further described as having first converging and then diverging portions in the direction of flow.

12. The device according to claim 11 wherein said one surface is further described as having a parallel portion interposed between said converging and diverging portions.

13. The device according to claim 1 wherein said fuel-air providing means contains an annular space surrounding said fuel nozzle for receiving air from the source of air and for discharging same into said cavity as the idling condition air quantity.

14. The device according to claim 2 further including air quantity control means in the air entrance passage.

15. The device according to claim 2 wherein the air entrance passage means is surrounded by additional air passage means joined to and opening into said induction manifold, said additional air entrance passage means having air quantity control means therein.

16. The device according to claim 15 including means for initially opening the air quantity control means in said air entrance passage means and thereafter opening the air quantity control means in said additional air passage means.

17. The device according to claim 1 including a plurality of fuel-air providing means.

* * * * *